US007173643B2

(12) United States Patent
Kubota et al.

(10) Patent No.: US 7,173,643 B2
(45) Date of Patent: Feb. 6, 2007

(54) PRINTING APPARATUS

(75) Inventors: Tsuyoshi Kubota, Kai (JP); Wataru Tsuruta, Yamanashi (JP); Takehito Kobayashi, Kai (JP)

(73) Assignee: Nisca Corporation, Yamanashi-Ken (JP)

( * ) Notice: Subject to any disclaimer, the term of this patent is extended or adjusted under 35 U.S.C. 154(b) by 359 days.

(21) Appl. No.: 10/957,672

(22) Filed: Oct. 5, 2004

(65) Prior Publication Data

US 2005/0083395 A1 Apr. 21, 2005

(30) Foreign Application Priority Data

Oct. 21, 2003 (JP) ..... 2003-360777

(51) Int. Cl.
*B41J 2/325* (2006.01)

(52) U.S. Cl. ..... 347/213

(58) Field of Classification Search ..... 347/213, 347/215, 216, 197, 198; 400/120.01
See application file for complete search history.

(56) References Cited

U.S. PATENT DOCUMENTS 6,679,637 B2 * 1/2004 Tsuruta et al. ..... 400/120.01
6,796,732 B2 * 9/2004 Kobayashi et al. .... 400/120.01

FOREIGN PATENT DOCUMENTS

JP 9-131930 5/1997
JP 11-348328 12/1999

* cited by examiner

*Primary Examiner*—K. Feggins
(74) *Attorney, Agent, or Firm*—Manabu Kanesaka

(57) ABSTRACT

A printing apparatus includes a printing device for selectively forming an image on a recording medium and a transfer medium, and a platen roller arranged opposite to the printing device. A nipping roller is arranged for nipping the transfer medium with the platen roller, and a mode setting device is used for setting a direct mode for forming the image on the recording medium and a indirect mode for forming the image on the transfer medium. A moving device moves the nipping roller to contact with and separate from the platen roller according to the direct mode and the indirect mode set by the mode setting device.

13 Claims, 8 Drawing Sheets

PRINTING APPARATUS

BACKGROUND OF THE INVENTION AND RELATED ART STATEMENT

The present invention relates to a printing apparatus for printing a variety of information such as images and characters on a recording medium such as a card. More particularly, the present invention relates to a printing apparatus capable of switching printing methods for transferring a variety of information to a surface of a recording medium or a transfer medium to form images thereon.

Conventionally, when card-shaped recording media such as credit cards, cash cards, license cards, and ID cards are produced, a transfer type printing apparatus is used for thermally transferring desired images and characters to a recording medium via a thermal transfer sheet with a thermal head to print the images. As an example, in Japanese Patent Publication (Kokai) No. 09-131930 (corresponding to U.S. Pat. No. 5,959,278), a printing apparatus of a direct transfer type directly transfers images and characters to a recording medium via a thermal transfer sheet. In this method, a thermal sublimate ink is used due to superior color tones, thereby attaining high quality images. However, it is necessary to provide a receptive layer on a surface of a recording medium to which images are transferred for receiving ink, thereby limiting a type of recording medium, or making it necessary to form the receptive layer on a surface of a recording medium.

Generally, as a recording medium capable of receiving a thermal sublimate ink, cards made of polyvinyl chloride (also known as PVC cards) have been widely used. However, since harmful substances are generated when such cards are incinerated, there has been a trend of switching to cards made of polyethylene terephthalate (also known as PET cards). Furthermore, in recent years, card-shaped media embedded with IC chips or antennae have been used in a variety of fields. Because an object is embedded in such a card, the card has an uneven surface, thereby making it difficult to transfer an image.

In order to solve the problems described above, Japanese Patent Publication (Kokai) No. 11-348328 has disclosed technology of a thermal transfer type printing apparatus, so-called an indirect transfer type printing apparatus, in which an image is formed on an intermediate transfer medium once, and is then transferred to a recording medium. In the indirect transfer method, it is possible to transfer an image to an uneven surface of a recording medium without limitation in card types associated with the receptive layer, i.e. disadvantages of the direct transfer printing method. Furthermore, it is easy to print an entire surface of the card-shaped recording medium compared to the direct transfer method.

However, in the indirect transfer method, it is necessary to use an intermediate transfer medium, thereby increasing running cost and printing time compared to the direct transfer method. Furthermore, depending on a design of the card, even if an entire front surface needs to be printed, only limited area of a backside is used for printing a text such as a precaution of the card in many cases. There are limited cases requiring printing the entire both surfaces, so there are merits and demerits associated with both methods of printing.

Therefore, depending on a material of the recording medium such as PVC and PET, and a characteristic and an printing purpose of the recording medium including an IC element, it is desirable that a printing apparatus can switch between the direct transfer method and the indirect transfer method to print images to a recording medium. With such a printing apparatus, it is possible to print with a method best suited for a specific recording medium and reduce running cost associated with the printing. Therefore, such a printing apparatus will be widely used in the future.

In a printing apparatus of the indirect transfer method described above, an intermediate transfer medium with a film shape is accurately placed on a platen roller arranged opposite to a thermal head, i.e. a member for forming an image. Then, the intermediate transfer medium is moved back and forth several times to form an image thereon. At this time, a roller member (clamp roller) may be provided for nipping and guiding the intermediate transfer medium with the platen roller, so that the intermediate transfer medium moves stably and accurately (refer to Japanese Patent Publication (Kokai) No. 11-348328). It is not necessary to provide such a roller member in a printing apparatus of the direct transfer method, in which an image is directly transferred to the recording medium such as a card.

Moreover, it is conceivable that a foreign material may be adhered to the roller member and transferred to a surface of the platen roller. In such a case, when an image is formed on the recording medium formed of a flexible material with the direct transfer method, the foreign material adhered to the platen roller forms an uneven portion on the recording medium, thereby causing improper image transfer. Such a problem may occur in the indirect transfer method as well when an image is formed on the recording medium with a film shape.

Specifically, in the printing apparatus capable of printing images to the recording medium by switching between the direct transfer method and the indirect transfer method as described above, to obtain proper images without the transfer problem, it is necessary to disable the function required for the indirect transfer method when the direct transfer method is used.

Furthermore, in the indirect transfer method, when the intermediate transfer medium is replaced, if the intermediate transfer medium set at a predetermined refilling position is shifted improperly, the intermediate transfer medium moves irregularly when an image subsequently is formed. In this case, it is necessary to correct the improper and weaving movement to an appropriate state.

In view of the problems described above, an object of the present invention is to provide a printing apparatus capable of printing images to a recording medium by switching between the direct transfer method and the indirect transfer method for convenience of a user, in which it is possible to print with a method best suited for the recording medium, thereby reducing running cost associated with the printing.

Another object of the present invention is to provide a printing apparatus in which it is possible to reduce a problem of improper transfer both in the direct transfer method and the indirect transfer method.

Further objects and advantages of the invention will be apparent from the following description of the invention.

SUMMARY OF THE INVENTION

In order to attain the aforementioned objects, according to a first aspect of the invention, a printing apparatus comprises printing means for selectively forming images on a card-shaped recording medium and film-shaped transfer medium; a platen roller arranged opposite to the printing means; a nipping roller for nipping the film-shaped transfer medium with the platen roller; moving means for moving the nipping roller to contact and separate from the platen roller; mode setting means for setting a first mode for forming the images on the card-shaped recording medium, or a second mode for forming the images on the film-shaped transfer medium. The moving means moves the nipping roller to contact or separate from the platen roller according to the first or the second mode set by the mode setting means.

In the first aspect, the mode setting means set the first mode for forming the images on the card-shaped recording medium, or the second mode for forming the images on the film-shaped transfer medium. The moving means moves the nipping roller to contact or separate from the platen roller according to the first ode or the second mode. It is perfectly acceptable that the nipping roller contacts or separates from the platen roller in the first mode, or conversely the nipping roller contacts or separates from the platen roller in the second mode.

For example, in the first mode, the nipping roller may separate from the platen roller, and in the second mode, the nipping roller may contact the platen roller. In this case, in the first mode, the moving means moves the nipping roller to separate from the platen roller. The nipping roller away from the platen roller advances into a card transport path to transport the card-shaped recording medium and the printing means forms the image on the card-shaped recording medium (using the direct transfer method). In the second mode, the moving means moves the nipping roller to contact the platen roller, and the film-shaped transfer medium is nipped between the platen roller and the nipping roller for transportation. The printing means forms the image on the film-shaped transfer medium, and the image on the film-shaped transfer medium is transferred to the card-shaped medium to form the image on the card-shaped medium (using the indirect transfer method).

At this time, the moving means may be configured to comprise a support member for supporting the nipping roller, and a drive mechanism for driving the support member to move the nipping roller between a first position for contacting the platen roller and a second position in the card transport path for transporting the card-shaped recording medium. The nipping roller may be formed of a plastic roller contacting a transfer surface of the film-shaped transfer medium having the image formed thereupon. Further, a cleaning roller may be provided for contacting an outer circumference of the platen roller to remove a foreign material adhered thereto.

According to a second aspect of the present invention, a printing apparatus comprises printing means for selectively forming images on a card-shaped recording medium and a film-shaped transfer medium; a platen roller arranged opposite to the printing means for supporting the card-shaped recording medium and the film-shaped transfer medium; a nipping roller for nipping the film-shaped transfer medium with the platen roller; moving means for moving the nipping roller to contact and separate from the platen roller; transfer medium transport means for transporting the film-shaped transfer medium; and transfer means for transferring the images formed on the film-shaped transfer medium to the card-shaped recording medium or a different card-shaped recording medium.

In the second aspect, the platen roller is arranged opposite to the printing means. The moving means moves the nipping roller to contact and separate from the platen roller. In the direct transfer method, the nipping roller is separated from the platen roller by the moving means, and the platen roller supports the card-shaped recording medium. The printing means forms the image on the card-shaped recording medium. On the other hand, in the indirect transfer method, the film-shaped transfer medium is nipped between the platen roller and the nipping roller when the moving means moves the nipping roller to contact the platen roller. The printing means forms the images while the film-shaped transfer medium is transported by the transfer medium transport means and is supported by the platen roller. The transfer means forms the images on the film-shaped transfer medium transported by the transfer medium transport means, and the images are transferred to the card-shaped recording medium or a different card-shaped recording medium.

In the second aspect, control means may be provided for controlling the transfer medium transport means and the moving means, so that when the film-shaped transfer medium is mounted at a predetermined position, the moving means moves the nipping roller to contact the platen roller after the transfer medium transport means moves the film-shaped transfer medium reciprocally relative to the platen roller for a predetermined number of times. With this configuration, the control means controls the transfer medium transport means and the moving means to move the film-shaped transfer medium reciprocally for a predetermined number of times to remove skew (weaving movement correction).

Advancing and retracting means may be provided for advancing and retracting the printing means with regard to the platen roller. An interconnecting mechanism may be also provided for interconnecting the advancing and retracting actions of the printing means by the advancing and retracting means, and the moving action of the nipping roller by moving means, thereby obtaining higher accuracy. At this time, when the advancing and retracting means moves the printing means to a non-image forming position away from the platen roller by a first predetermined distance, the interconnecting mechanism interconnects the actions of the printing means and the nipping roller, so that the moving means moves the nipping roller to separate from the platen roller. Further, when the advancing and retracting means moves the printing means to an idling position away from the platen roller by a second predetermined distance smaller than the first predetermined distance where the printing means can perform the image forming operation, the nipping roller is maintained in a state contacting the platen roller. The nipping roller may be formed of a plastic roller contacting a transfer surface of the film-shaped transfer medium having the image formed thereupon. Further, a cleaning roller may be provided for contacting an outer circumference of the platen roller to remove a foreign material adhered thereto.

According to the present invention, the printing apparatus can switch the actions of the printing means, the platen roller and the nipping roller, i.e. the same configuration, for printing the images to the card-shaped recording medium according to the mode (the first or the second mode) and the transfer method (the direct transfer method and the indirect transfer method). Therefore, it is possible to reduce cost of the printing apparatus and running cost associated with the printing. Also, the moving means is employed for moving the nipping roller nipping the film-shaped transfer medium with the platen roller to contact and separate from the platen roller, thereby improving the transport precision of the film-shaped transfer medium and reducing improper transfer in the two modes (the first and the second mode).

DETAILED DESCRIPTION OF PREFERRED EMBODIMENTS

Figure 1:
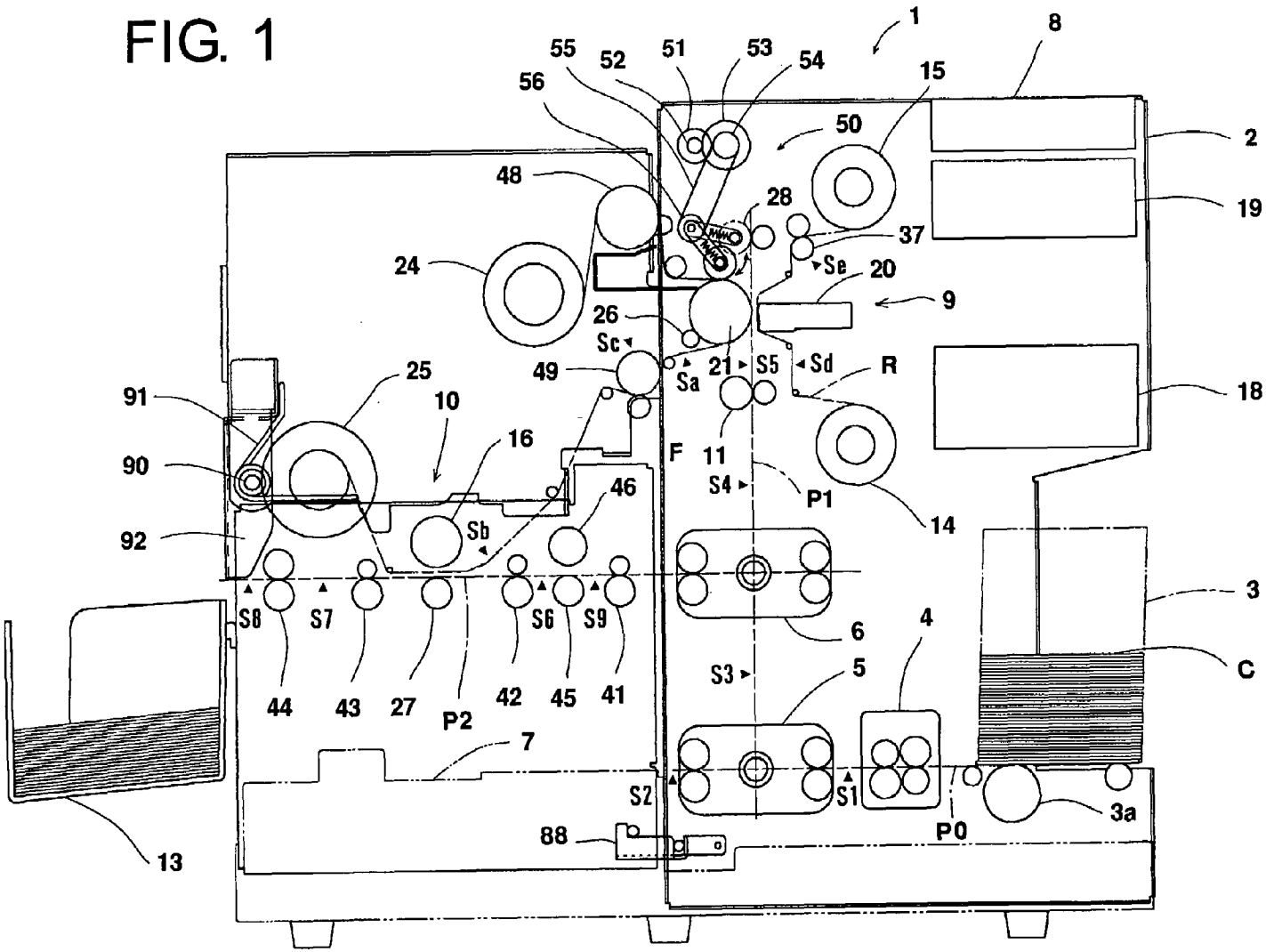
FIG. 1 is a front view showing a general structure of a printing apparatus according to a first embodiment of the invention.

Hereunder, embodiments of the present invention will be explained with reference to the accompanying drawings. As shown in FIG. 1, according to a first embodiment of the present invention, a printing apparatus 1 comprises, in a frame 2 as a housing, a horizontal card transport path P0 for kicking out a card C, i.e. a card-shaped recording medium, and for transporting the card C substantially horizontally; a first card transport path P1, i.e. a card transport path, for forming (printing) images on the card C with a direct transfer method; and a second card transport path P2 for transferring images temporarily held on an intermediate transfer sheet F as a film-shaped transfer medium to the card C with an indirect transfer method.

The first card transport path P1 is arranged substantially in the vertical direction, and extends through central positions of a first card turning unit 5 and a second card turning unit 6 for switching a transport direction of the card C. The first card transport path P1 intersects the horizontal card transport path P0 and the second card transport path P2 arranged substantially horizontally.

On the horizontal card transport path P0, there are arranged a card supply unit 3 for separating and feeding the card C one at a time to the horizontal card transport path P0; a cleaner 4 for cleaning both surfaces of the card C at a downstream side of the card supply unit 3; and a first turning unit 5 arranged at a downstream side of the cleaner 4 for rotating or inverting the card C while nipping the card C, so that the transport path of the card C is switched orthogonally to the first card transport path P1.

The card supply unit 3 comprises a card stacker for storing a plurality of the cards C in a stacked state. A stacker side plate is arranged on the card stacker to face the horizontal card transport path P0, and has an opening slot for allowing only one card C to pass therethrough. To the bottom of the card stacker is pressingly arranged the kick roller 3*a* that rotates to feed the bottommost one of the blank cards C stored in the card stacker to the horizontal card transport path P0.

The cleaner 4 comprises a pair of cleaning rollers made of a rubber material and having surfaces applied with a sticky substance. Also, the cleaner 4 has a pair of pressing rollers pressing against the cleaning rollers. The cleaning rollers and the pressing rollers face each other with the horizontal card transport path P0 in between.

The first card turning unit 5 comprises pairs of pinch rollers for nipping the card C, and a turning frame for supporting the pinch rollers rotatably to turn or invert around a center position of the first card turning unit 5. The pinch rollers are composed of a drive roller capable of both forward and reverse rotations, and a follower roller. These rollers are pressed against each other to sandwiching the horizontal transport path P0 when the turning frame is horizontally positioned (state shown in FIG. 1) and are in pressing contact to sandwich the first card transport path P1 when the turning frame is vertically positioned. When the turning frame is rotated or turned while the pinch rollers nip the card in between, the pinch rollers also rotate thereby displacing the card C, so the rotating or turning action at the first card turning unit 5 is driven independently to the rotation or inversion of the turning frame and to the rotation of the pinch rollers. (This is the same for the second card turning unit 6.).

Note that near the first card turning unit 5 is arranged a unitized transmissive sensor (combined with the slit plate, not shown) for detecting a rotational angle of the turning frame. Also, to determine a rotational direction of the pinch rollers, a unitized transmissive sensor (combined with a semi-circular plate, not shown) is arranged to detect a position of one of the pinch rollers. While the rotational angle of the rotating frame can be freely set, the direction of the transport of the card C by the pinch rollers is controlled. (This is the same for the second card turning unit 6.)

Also, a magnetic encoder 7 (or an IC encoder) is arranged on a line extending from the horizontal card transport path P0 at a downstream side of the first card turning unit 5 for recording information related to an owner of the card C to the card C. The first card turning unit 5 receives and hands over the card C from and to the magnetic encoder 7.

On the first card transport path P1 from a lower side to an upper side, there are disposed the first card turning unit 5; the second card turning unit 6 capable of rotating or turning to feed the card C handed over from the first card turning unit 5 to the image forming unit 9 (described in further detail below), i.e. the printing means, and to feed the card C transported from the image forming unit 9 toward the second card transport path P2; and pairs of capstan rollers 11 and follower rollers 12 (see FIG. 2) rotating at a constant rotational speed.

Furthermore, on the first card transport path P1, there is arranged an image forming unit 9 between the capstan rollers 11 and the follower rollers 12 that uses thermal transfer ink to selectively form images on the card C or the intermediate transfer sheet F (to form images onto one of them) according to image data (both positive and negative images) supplied from the thermal head control unit 19H (see FIG. 5, described later). A thermal transfer printer configuration is employed in the image forming unit 9 having the platen roller 21 for supporting the card C and the intermediate transfer sheet F when printing (when forming images) to a surface thereof and the thermal head unit 20 retractably arranged with regard to the platen roller 21. The thermal transfer sheet R is interposed between the platen roller 20 arranged opposite to the thermal head unit and the thermal head unit 21.

The thermal transfer sheet R comprises the thermal sublimate inks of Y (yellow), M (magenta), C (cyan), and Bk (black) in this order at a width slightly longer than a length of the card C. After the Bk (black) section, there is a protective layer region for protecting the surface of the card C with an image formed thereon. Each of the sections is formed repeatedly in order to form a band or belt shape. The band or belt is generally called an ink ribbon. On the other hand, on the intermediate transfer sheet F, there are formed layers of a base sheet Fa, a back surface coating layer Fb formed on a backside of the base sheet Fa, a receptive layer Fe for receiving the inks, and an overcoat layer Fd for protecting the receptive layer Fe surface. A peeling surface Fc is formed on the base sheet Fa for facilitating heat peeling of the overcoat layer Fd and the receptive layer Fe from the base sheet Fa as a single piece. The back surface coating layer Fb, the base sheet Fa, the peeling surface Fc, the overcoat layer Fd, and the receptive layer Fe are formed in layers in this order from a bottom.

The image forming unit 9 comprises a configuration for positioning the thermal head 20*a* formed at a leading edge of the thermal head unit 20 using the advancing and retracting mechanisms 30 (described below) as the advancing and retracting means. The positions are a printing position (a) (see FIG. 4C), a print idling position (b) (see FIG. 4B), and a thermal transfer sheet replacement position (c) (see FIG. 4A).

The printing position (a) described above is a position where the thermal head 20*a* is pressed against the card C with the thermal transfer sheet R in between in the direct transfer mode, or against the intermediate transfer sheet F in the indirect transfer mode. The card C and the intermediate transfer sheet F are supported by the platen roller 21. The print idling position (b) is a position where the thermal head 20*a* is separated slightly away from the printing position (a) (approximately 5 mm) when the thermal transfer sheet R moves to bring the next section M (magenta) to the printing position after transferring Y (yellow), for example when printing color images by overlaying the colors of Y (yellow), M (agenda), and C (cyan). This is an idling position for a continuous operation when printing color images. In this case, after transferring M (magenta), the thermal head 20*a* is positioned at the print idling position (b) in the same way to feed the thermal transfer sheet R to bring the next section C (cyan) to the printing position. Also, when the predetermined printing is completed, the thermal head 20*a* is positioned at the print idling position (b) and idles until it receives the next printing instruction.

The thermal transfer sheet replacement position (c) is, as the name implies, a position to separate the thermal head 20*a* from the platen roller 21 by a predetermined distance (approximately 25 mm) when replacing the thermal transfer sheet R. In a normal continuous printing, the thermal head 20*a* reciprocally moves between the printing position (a) and the print idling position (b). In other words, the thermal transfer sheet replacement position (c) is a non-operating position (a non-image forming position) where printing is not performed.

Figure 3:
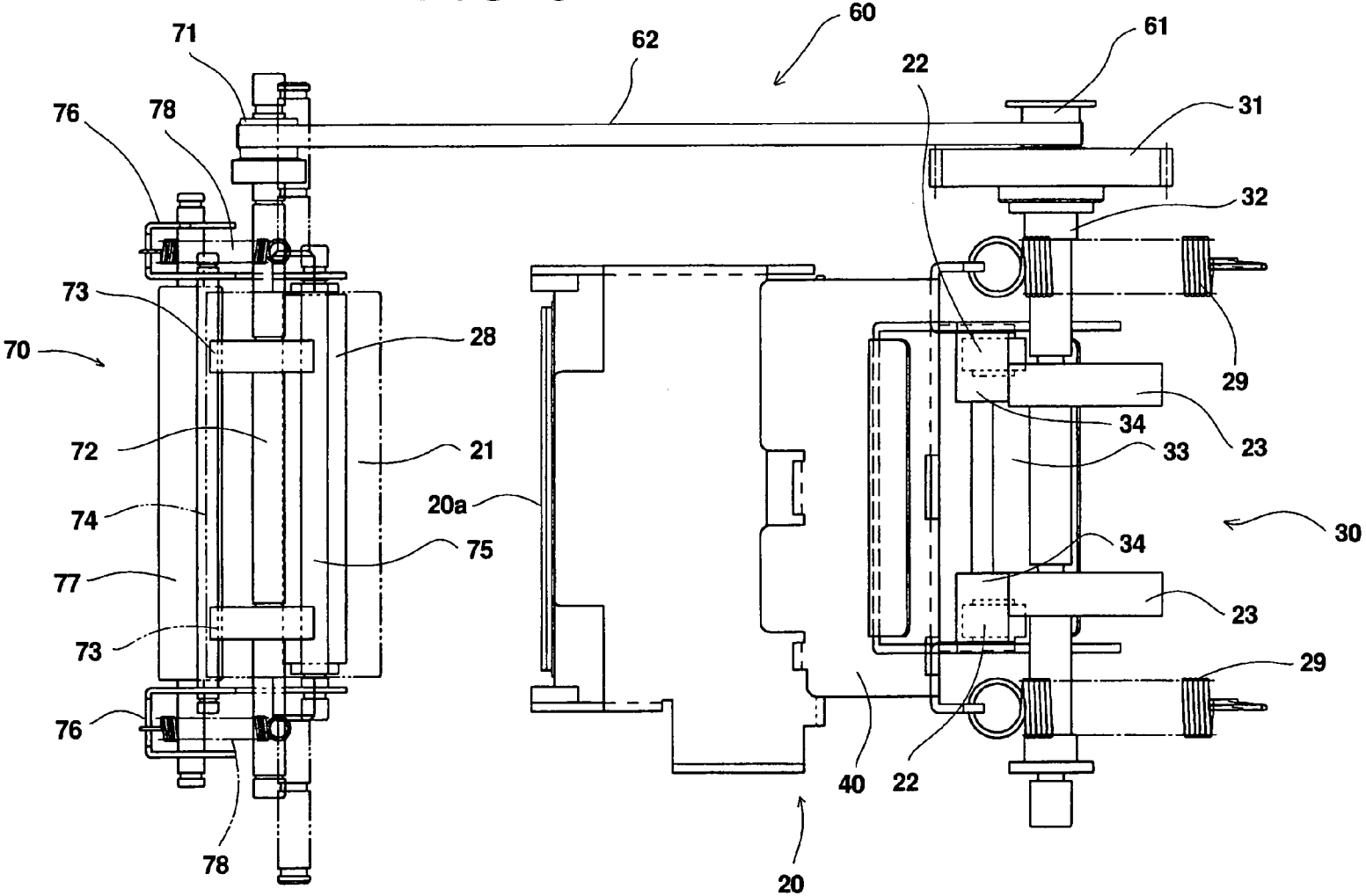
FIG. 3 is a plan view of the area near the image forming unit of the printing apparatus according to the first embodiment.

Thus, as described above, the movement of the thermal head 20*a* to the printing position (a), to the print idling position (b), and to the thermal transfer sheet replacement position (c) is performed by the advancing in retracting mechanism 30. As shown in FIG. 3, the thermal head unit 20 with the thermal head 20*a* is detachably supported on the head holder 40. A pair of rollers 22 is disposed on an end of the head holder 40. When a DC motor (not shown) drives, the drive is transmitted to a gear 31. It is then transmitted to a pair of eccentric cams 23 with a non-circular shape via a shaft 32 disposed in the center of the gear 31. In other words, the eccentric cams 23 are fastened on the shaft 32 with predetermined gaps, and rotate in synchronization to the gear 31.

The eccentric cams 23 and a pair of rollers 22 disposed on an end of the head holder 40 are interconnected by an arm 33. A pair of rollers 34 contacts the eccentric cams 23 and is disposed on a part of the arm 33. The arm 33 is configured to swing around a swinging pivot point 35 with rotation of the eccentric cams 23. A part of the arm 33 at the opposite side of the swinging pivot point 35 has a contact relationship with the rollers 22 on the head holder 40 with the rollers 34 contacting the eccentric cam 23 in between. With this configuration, it is possible for the thermal head unit 20 supported on the head holder 40 to advance and retract with regard to the platen roller using the swinging of the arm 33. Note that a spring 29 constantly urges the head holder 40 in a direction away from the platen roller 21.

As described above, by controlling the rotation of the eccentric cam 23 on the advancing and retracting mechanism 30, it is possible to move the thermal head 20*a* to the printing position (a), the print idling position (b), and the thermal transfer sheet replacement position (c). In this way, the rotation of the eccentric cam 23 is controlled so that when the thermal head 20*a* is positioned at the printing position (a), a largest diameter area of the eccentric cam 23 touches the roller 34. When the thermal head 20*a* is positioned at the print idling position (b), a middle diameter area of the eccentric cam 23 touches the roller 34. When the thermal head 20*a* is positioned at the thermal transfer sheet replacement position (c), a smallest diameter area of the eccentric cam 23 touches the roller 34.

Therefore, in the direct transfer method to form (print) images directly to the card C, the thermal head 20*a* presses against the card C with the thermal transfer sheet R interposed therebetween. In this state, by selectively heating a plurality of heating elements on the thermal head 20*a*, the thermal transfer ink components of Y, M, and C dispensed in this order onto the thermal transfer sheet R are thermally transferred to the surface of the card C, thereby forming an image of the desired image information onto the surface of the card C.

In the indirect transfer method to form images onto the intermediate transfer sheet F, the thermal head 20*a* presses against the intermediate transfer sheet F with the thermal transfer sheet R interposed therebetween. In this state, by selectively heating a plurality of the heating elements on the thermal head 20*a*, the thermal transfer ink components dispensed to the thermal transfer sheet R are thermally transferred to the surface of the intermediate transfer sheet F, thereby forming (printing) an image of the desired image information onto the surface of the intermediate transfer sheet F.

As shown in FIG. 1, the thermal transfer sheet R is supplied from the thermal transfer sheet supply unit 14 where the thermal transfer sheet R is wound in a roll, and is guided by a plurality of guide rollers while touching substantially the entire surface of the thermal head 20*a*. Then, the thermal transfer sheet R is driven along by the rotational drive of the paired take-up rollers 37, and is rolled onto the thermal transfer sheet take-up unit 15. The thermal transfer sheet supply unit 14 and the thermal transfer sheet take-up unit 15 are arranged at positions on both sides of the thermal head unit 20 with their centers mounted onto spool shafts. To the image forming unit 9, a light emitting element and a light receiving element (hereinafter called light reception sensor Sd) are separately arranged perpendicular to the thermal transfer sheet R between the two guide rollers arranged between the thermal transfer sheet supply unit 14 and the thermal head unit 20 for detecting a positioning mark of the thermal transfer sheet R or a position of the Bk portion on the thermal transfer sheet R.

Note that a gear (not shown) engages a drive side roller shaft of the paired take-up rollers 37. The gear meshes with a gear that comprises a clock plate (not shown) on the same shaft. Near the clock plate (not shown), there is arranged a light receiving sensor Se for detecting the rotation of the clock plate (not shown) to control a take-up amount of the thermal transfer sheet R.

Figure 2:
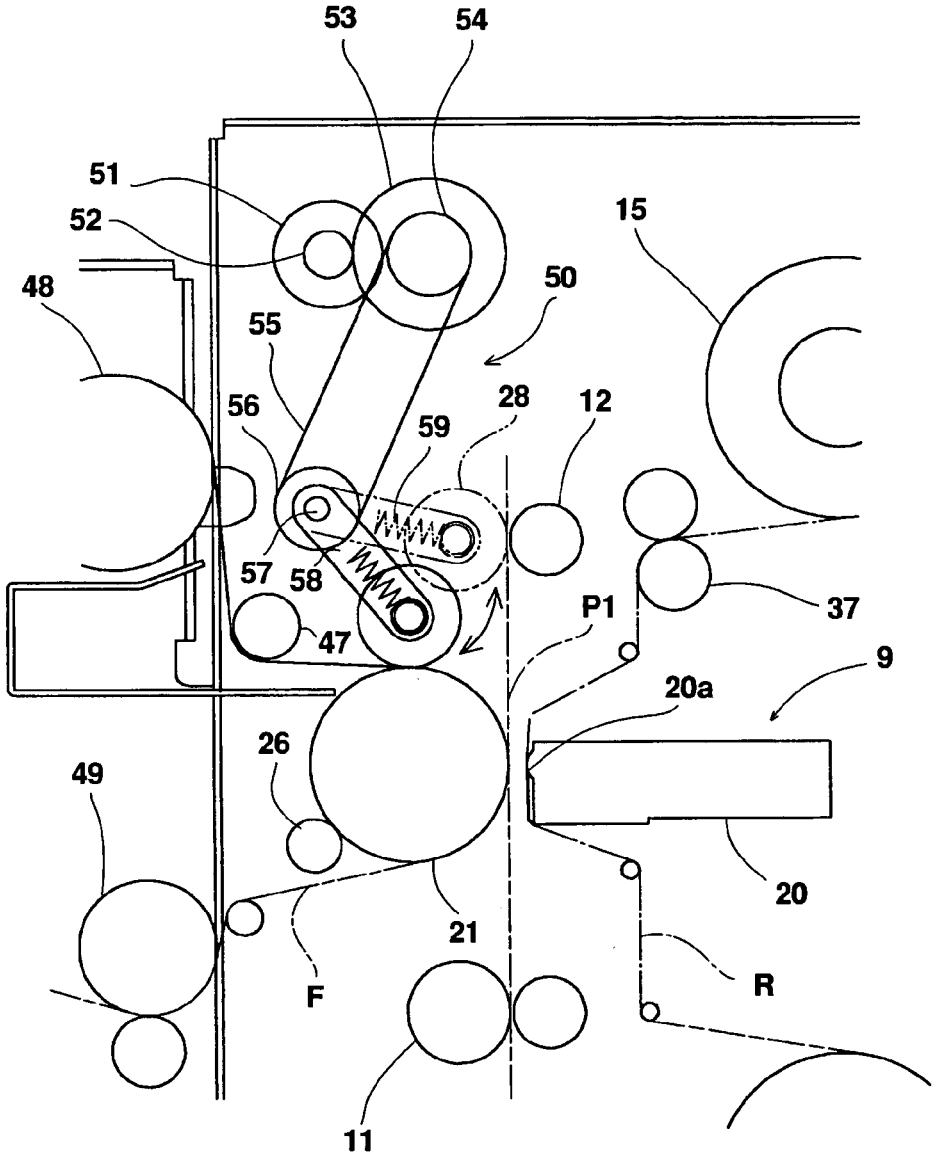
FIG. 2 is an enlarged view of an area near an image forming unit of the printing apparatus according to the first embodiment.

As shown in FIGS. 1 and 2, the platen nipping roller 28 is configured to press the intermediate transfer sheet F against the surface of the platen roller 21 by contacting the platen roller 21, thereby nipping the intermediate transfer sheet F with the platen roller (see solid lines for the platen nipping roller 28 in FIG. 2) and separating from the platen roller 21 (see hidden lines for the platen nipping roller 28 in FIG. 2). The action for the platen nipping roller 28 to contact and separate from the platen roller 21 is performed by the moving mechanism 50 as the moving means.

The moving mechanism 50 comprises a motor (stepping motor) 51 capable of both forward and reverse rotations as the drive source. The rotational drive force of the motor 51 is transmitted from the gear 52 disposed on the drive shaft of the motor 51 to the gear 53 adjacent thereto, so that a pulley 54 arranged on the same shaft as the gear 53 rotates in a predetermined direction. A timing belt 55 is placed between the pulley 54 and a pulley 56. The rotational drive of the pulley 54 is transmitted to the pulley 56 via the timing belt 55.

An end of the lever member 58 as the support member is fastened to the rotating shaft 57 of the pulley 56. The platen nipping roller 28 is rotatably supported on the other end of the lever member 58. Therefore, the rotational drive transmitted to the pulley 56 causes the lever member 58 to swing in a predetermined direction around the rotating shaft 57, so that the platen nipping roller 28 moves. Because the motor 51 is capable of both forward and reverse rotations, it is possible to move the platen nipping roller 28 in the direction opposite to that of the movement described above via the drive transmission mechanisms by controlling the drive in the direction opposite to that of the drive described above.

According to the embodiment, the platen nipping roller 28 pushes the intermediate transfer sheet F against the platen roller 21. When the motor is driven in the forward direction while the intermediate transfer sheet F is positioned at the nipping position between the platen nipping roller 28 and the platen roller 21 (the first position contacting the platen roller), the platen nipping roller 28 moves in the direction to separate from the platen roller 21 and advances into the first card transport path P1 (the second position enabling transport of the card c) for transporting the card C and functions as a transport roller in cooperation with the follower roller 12 to transport the card C at a constant speed when printing to the card (when using the direct transfer mode) in the same way as the capstan roller 11 (see hidden lines for the platen nipping roller 28 in FIG. 2).

In this case, when it is necessary to apply a rotational drive force for the platen nipping roller 28 to transport the card C, it is possible to apply the drive transmission from a drive motor (not shown) by configuring a gear (not shown) disposed on the same shaft to mesh with a separate gear (not shown) at the second position, so that the platen nipping roller 28 rotates along with the rotation of the shaft. Also, if the motor 51 rotates in reverse when the platen nipping roller 28 is positioned at the second position, the platen nipping roller 28 moves in the direction opposite to the direction of the movement described above. The platen nipping roller 28 moves to a position to contact the platen roller with the intermediate transfer sheet F interposed therebetween (first position indicated by the solid lines in FIG. 2.). Also, a pressing spring (pushing spring) 59 is provided to urge the platen nipping roller 28 toward the platen roller 21 at the first position, and toward the opposing follower roller 12 at the second position.

Note that because the platen nipping roller contacts the transfer surface of the intermediate transfer sheet F with images formed thereon in the indirect transfer mode, it is preferable to use a plastic roller rather than a rubber roller to which a foreign material easily adheres. Therefore, in the embodiment, a POM (polyoxyethylene, polyacetal) roller is employed. Still further, in this embodiment, a rubber roller 26 with a low hardness level (40) is used as a cleaning roller to remove a foreign material adhered to the surface of the platen roller 21 by constantly contacting the platen roller 21. Note that the hardness of the roller used in the embodiment is 85 for the platen roller, 60 for the card transport rollers such as the capstan roller, and 40 for the rubber roller 26.

Also, to the platen roller 21, there is placed the intermediate transfer sheet F on the outer circumference of the thermal head unit 20 side. The intermediate transfer sheet F is placed with the receptive layer Fe facing the thermal transfer sheet R and the back surface coating layer Fb side touching the platen roller 21. When printing to the card C using the direct transfer method and forming images on the intermediate transfer sheet F, the transport speed of the intermediate transfer sheet F is set to the same speed as that of the thermal transfer sheet R. Furthermore, when printing to the card C using the direct transfer method, the transport speeds of the intermediate transfer sheet F and the card C are set to be the same. Note that to a position below the rubber roller 26 on the image forming unit 9, the light emitting element and the light receiving element (called light reception sensor Sa below) for detecting the mark for positioning the intermediate transfer sheet F are separately arranged perpendicular to the intermediate transfer sheet F.

As shown in FIG. 1, pairs of capstan rollers 41, 42, and 43, a pair of decal rollers composed of rollers 45 and 46 for correcting skew of the card C transferred with an image from the intermediate transfer sheet F, and a pair of discharge rollers 44 for discharging the card that after the printing process are arranged at a downstream side of the second card turning unit 6 on the second card transport path P2. Also, between the pair of capstan rollers 42 and 43 on the second card transport path P2, there is disposed a transfer unit 10 for transferring images formed on the intermediate transfer sheet F to the card C. The transfer unit 10 comprises a platen roller 27 for supporting the card C when transferring from the intermediate transfer sheet F to the card C and a heat roller 16 slidably arranged to the platen roller 27. Embedded in the heat roller 16 is a heating lamp as a heating body for heating the intermediate transfer sheet F. The intermediate transfer sheet F is interposed between the platen roller 27 and heat roller 16.

The sheet roller 16 can advance and retract with regard to the platen roller 27 by an advancing and retracting mechanism (not shown). The advancing and retracting mechanism is configured of a holder for detachably holding the heat roller 16; a follower roller fastened to the holder; a non-circular heat roller raising and lowering cam for rotating in one direction around a cam shaft while in contact with an outer circumference of a follower roller; and a spring embedded in the holder for pushing an upper surface of the holder against the heat roller raising and lowering cam.

The roller 45 constituting the pair of decal rollers can move from the card transport position shown in FIG. 1 to a position where it touches the roller 46 on the upper side of the second card transport path P2 by a cam mechanism (not shown). To reduce a pushing force of the raised roller 45 (to a position that contacts) against the card C, an elastic body (spring, not shown) is hooked to a rotating shaft of the roller 46. Also, the platen roller 27 is rotatably driven by being interlocked to the drive rollers of the pairs of capstan rollers 41, 42, and 43 (rollers arranged on the bottom side) and a drive mechanism (not shown) for transporting the card C. The drive roller side of the paired discharge rollers 44 (on the bottom side) is also rotatably driven by a drive mechanism and is interlocked with the paired capstan rollers 41.

The intermediate transfer sheet F is supplied from the intermediate transfer sheet supply unit 24 with the intermediate transfer sheet F rolled thereabout, and is guided by the transport roller 48, the guide roller 47 (see FIG. 2), the platen roller 21, and the back tension roller 49 for applying a reverse tension to the intermediate transfer sheet F. When transferring, the card C is sandwiched between the platen roller 27 and heat roller 16 on the second card transport path P2, and the intermediate transfer sheet F is taken up by the intermediate transfer sheet take-up unit 25. These rollers and the pulse motor M2 (not shown, described below) function as the transfer medium transport means for transporting the intermediate transfer sheet F.

Note that in the image forming unit 10, the light emitting element and light receiving element (hereinafter referred to as the light receiving sensor Sb) for detecting the mark for positioning the intermediate transfer sheet F are arranged with the intermediate transfer film F in between. Also, a discharge stacker 13 is detachably mounted to the outside of the frame 2 below the second card transport path P2 to store the cards C discharged from a discharge outlet formed in the frame 2 after the printing process.

The printing apparatus 1 is divided into a first unit for housing the configuring members and moving mechanism 50 arranged on the horizontal card transport path P0 and the first card transport path P1; and a second unit for housing the configuring members arranged on the second card transport path P2, the magnetic encoder 7, the intermediate transfer sheet supply unit 24, and the intermediate transfer sheet take-up unit 25. A locking lever 88 is used to maintain a predetermined distance between the first unit and the second unit. By releasing the locking lever, the second unit can have a structure enabling horizontal movement (horizontal movement to the left side in FIG. 1) relative to the first unit over a rail (not shown).

The second unit is formed of an upper first block and a lower second block with the second card transport path P2 as a boundary. The first block is interlocked to the second block positioned below with a shaft 90 via mounting members (not shown). Specifically, the first block is configured to be rotatable with regard to the second block with the shaft 90 arranged on an edge of the frame 2 as a revolving point.

Near both edges of the shaft 90 (in a depth direction of the card surface in FIG. 1), a coiled spring 91 is disposed to urge the first blocked in a revolving direction with regard to the second block. Both edges of the shaft 90 are mounted to the cover portion 92 with one edge screwed into the first block. The cover portion 92 revolves along with the first block. Therefore, the first block has a structure capable of opening with regard to the second block. When the first block is opened, one side of the coiled spring 91 is covered by a cover member 92. The cover member 92 is regulated on the first block by touching a side surface of a mounting member (not shown) between the first block and the second block. The cover member 92 rotates in the direction to open or close along a circle substantially at an angle of 90 degrees with regard to the second block.

A drive mechanism (not shown) comprising a plurality of gears, pulleys and a solenoid clutch is arranged above the second card transport path P2 in the first block. The pulse motors M1 and M2 capable of both forward and reverse rotations drive each of the rollers disposed on the second card transport path P2, the intermediate transfer sheet supply unit 24, the intermediate transfer sheet take-up unit 25, the transport roller 48, the platen roller 21, and the back tension roller 49.

A plurality of unitized transmissive sensors is disposed on the printing apparatus 1 along the horizontal card transport path P0, the first card transport path P1, and the second card transport path P2 for detecting the position of the card C. Specifically, the unitized transmissive sensor S1 is arranged between the cleaner 4 and the first card turning unit 5 along the horizontal card transport path P0, and the unitized transmissive sensor S2 is disposed near the first card turning unit 5 on the magnetic encoder 7 side. The unitized transmissive sensor S3 is arranged from the first card turning unit 5 to the second card turning unit 6 side along the first card transport path P1. The unitized transmissive sensor S4 is arranged near the second card turning unit 6 on the capstan roller 11 side, and the unitized transmissive sensor S5 is arranged between the capstan roller 11 and the platen roller 21. The unitized transmissive sensor S9 is arranged between the pair of the decal rollers and the capstan rollers 41 along the second card transport path P2. The unitized transmissive sensor S7 is arranged between the pair of capstan rollers 42 and the pair of decal rollers (rollers 45, and 46), and the unitized transmissive sensor S8 is arranged in front of the discharge outlet. These sensors detect the leading-edge and the trailing edge of the card C that is being transported.

Note that in the following description, the card C is transported in the up and down directions over the first card transport path P1, and is transported in the left and right directions over the second card transport path P2 shown in FIG. 1. Accordingly, with the transport direction of the card C as a reference, the leading edge of the card in the transport direction means the leading edge, and the trailing edge in the transport direction means the trailing edge.

Furthermore, in the frame 2, the printing apparatus 1 comprises a power supply unit 18 that converts commercial alternating current power into direct current power to drive/operate each mechanism and control unit; a control unit 19 as control means for controlling all operations of the printing apparatus 1 and as a part of the mode setting means; and a touch panel 8 on the upper portion of the frame 2 that displays a status of the printing apparatus 1 according to the information received from the control unit 19, and as a part of mode setting means that allow an operator to input operating instructions to the control unit 19.

Figure 5:
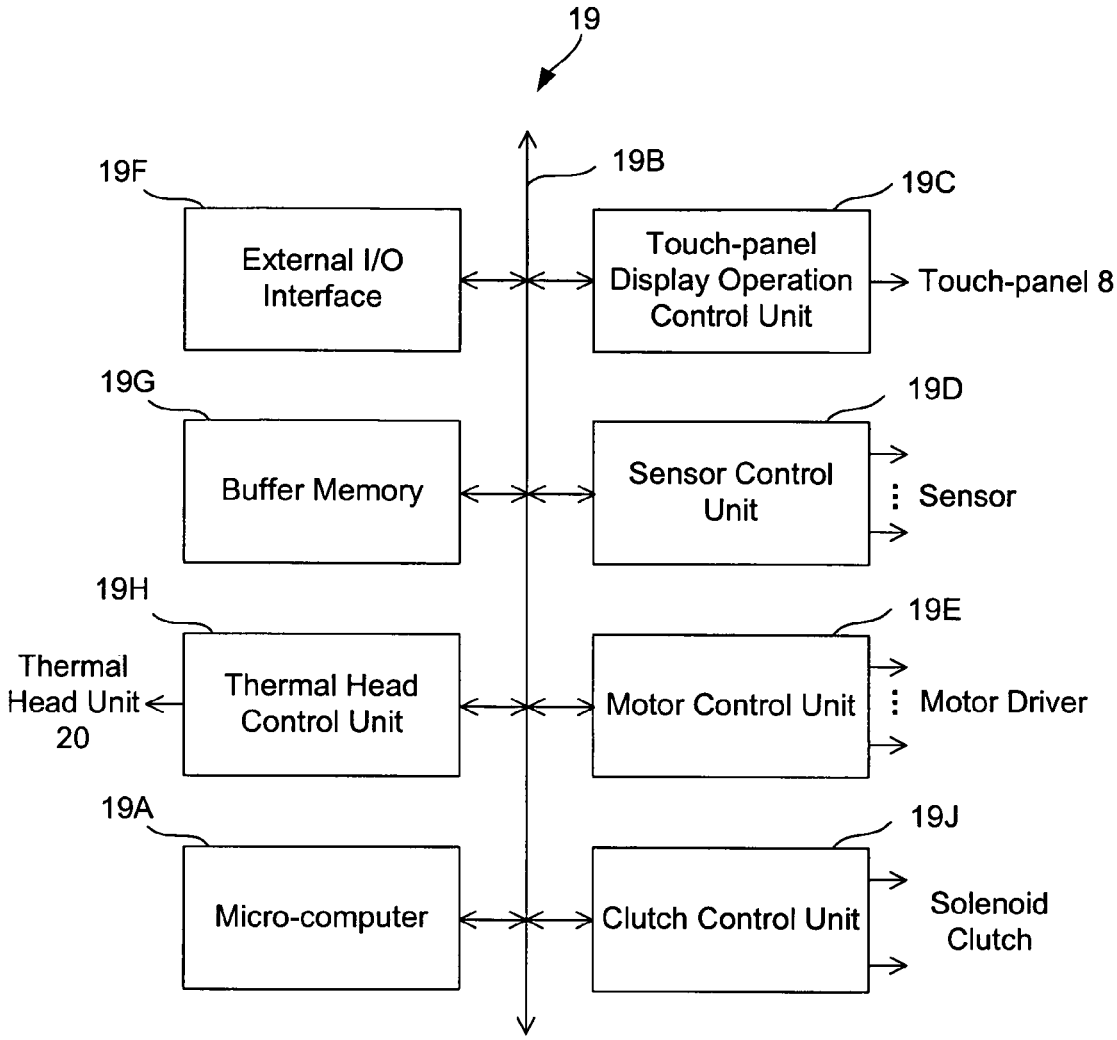
FIG. 5 is a block diagram showing a printing apparatus control unit in detail according to the first embodiment.

As shown in FIG. 5, the control unit 19 comprises a micro-computer 19A that controls the printing apparatus 1. The micro-computer 19A comprises a CPU that operates with a fast clock speed as a central processing unit, a ROM that stores control operations for the printing apparatus 1, a RAM that acts as a working area on the CPU, and an internal bus that connects them.

An external bus 19B is connected to the micro-computer 19A. Connected to the external bus 19B are a touch-panel display operation control unit 19C that controls the display and operating instructions of the touch panel 8; a sensor control unit 19D that controls signals from each sensor; a motor control unit 19E that controls the motor driver for outputting drive pulses to each motor; an external I/O interface 19F that communicates with a host device such a PC and the printing apparatus; a buffer memory 19G that temporarily stores the image data to be printed on the card C; a thermal head control unit 19H that controls the thermal energy of the thermal head 20; and a clutch control unit 19J that outputs control signals to turn on and off a solenoid clutch (not shown).

The touch-panel display operation control unit 19C, the sensor control unit 19D, the thermal head control unit 19H, and the clutch control unit 19J are each connected to the touch panel 8, the sensors, the drivers of each motor, the thermal head 20 and the solenoid clutch (not shown).

The following will describe the operations of the printing apparatus 1 in the present embodiment, focusing on the CPU of the micro-computer 19A in the control unit 19, in reference to the flow charts. Note that the RAM converts the image information received from an external device like a PC via the external I/O unit 19F and the memory buffer 19G into positive data and mirror image data, and then stores the data.

When power is supplied to the printing apparatus 1, the CPU displays an initial screen on the touch-panel 8, via the touch-panel display and operations control unit 19C. At this time, the touch-panel 8 (or the external computer monitor) displays a mode setting button for setting the indirect transfer mode as the first mode or the direct transfer mode as the second mode; a clear button for clearing the mode set by the mode setting button; a start button for starting printing with the mode set on the printing apparatus 1; the status of the printing apparatus 1 in standby or ready for printing; and the number of cards printed. The image forming routine for forming (printing) an image on the card C is in a ready state.

Figure 6:
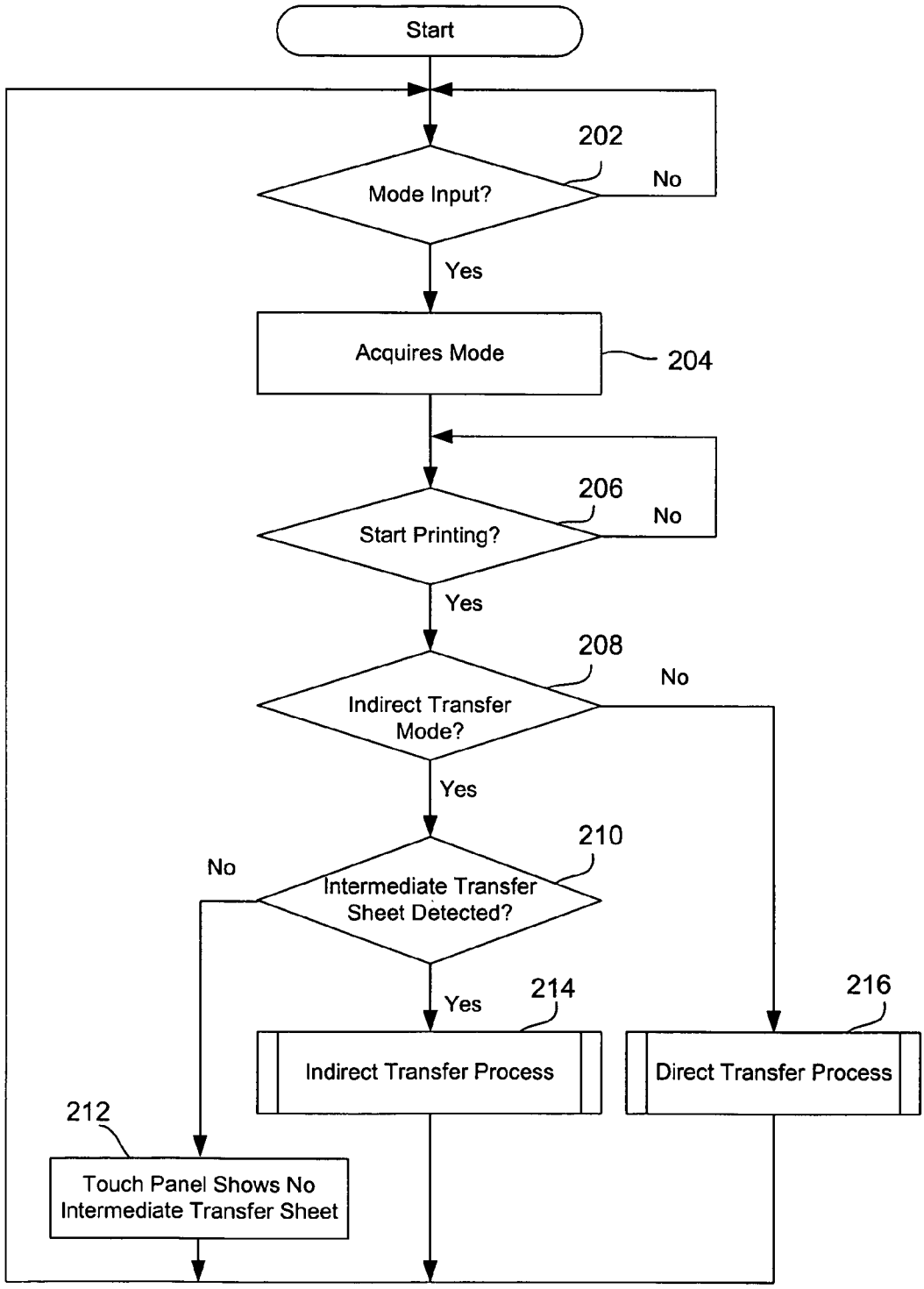
FIG. 6 is a flowchart of an image forming routine executed by a printing apparatus control unit CPU according to the first embodiment.

As shown in FIG. 6, in the image forming routine, at step 202, the system idles until a mode for the direct transfer mode (the first mode) or the indirect transfer mode (the second mode) is input from the touch-panel 8 (or an external PC). When a mode is input, at the next step 204, the input mode default values are stored (acquired) in the RAM. At step 206, the system idles until the start of printing is specified from the touch-panel 8 (or the external PC). When printing is started, at step 208, the system determines whether the mode stored in RAM is the intermediate transfer mode. If the judgment at step 208 is affirmative, at step 210, the system determines whether the light receiving sensor Sb detects the existence of the intermediate transfer film F. If negative, images can not be formed using the indirect transfer method, so at step 212, the touch-panel 8 displays a message to indicate that there is no intermediate transfer sheet F (or the PC notifies that there is no intermediate transfer sheet F). This ends the image forming routine and returns to step 202. When affirmative, at step 214, the system executes the indirect transfer processing sub-routine to form images on the card C using the indirect transfer method.

Figure 7:
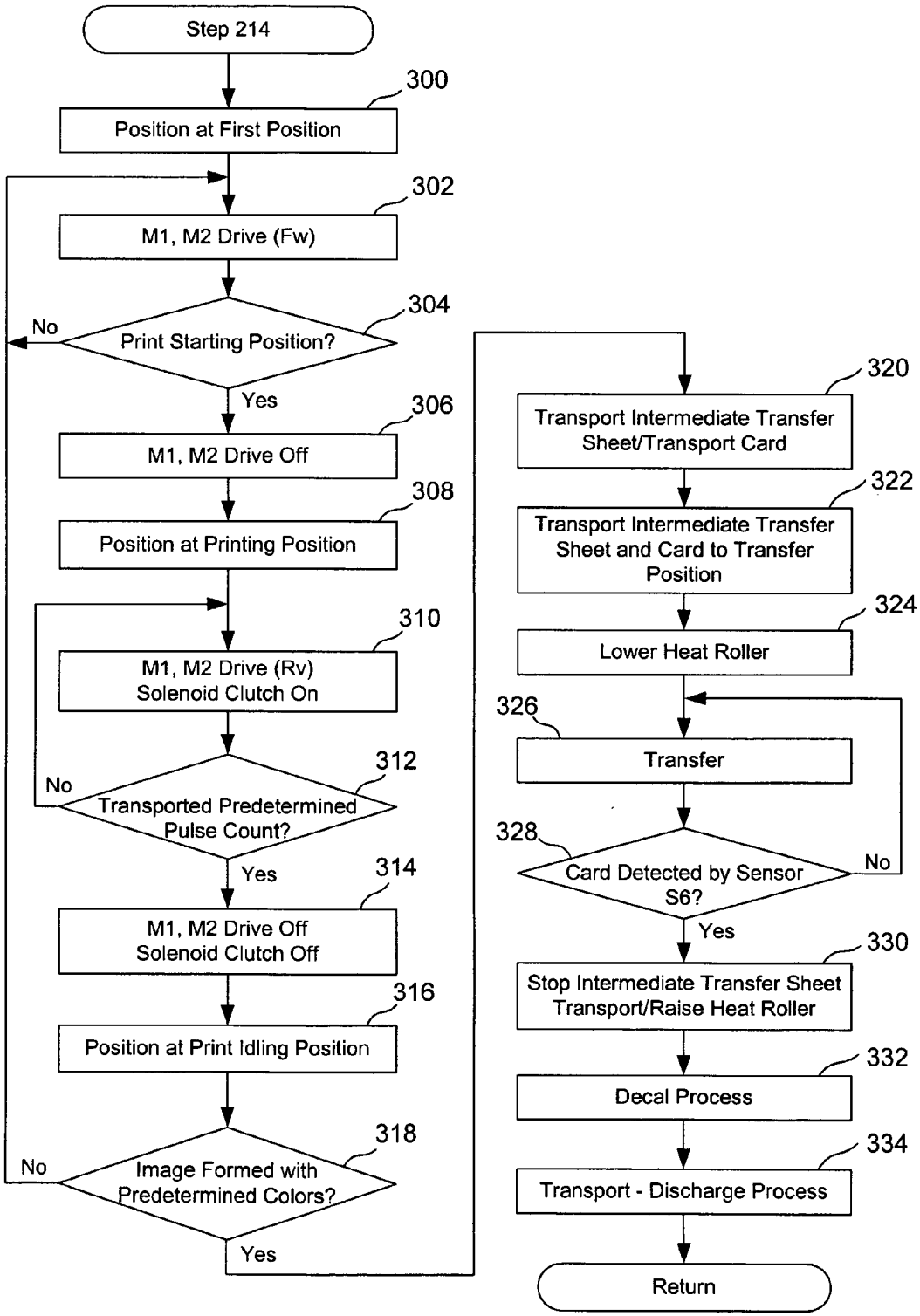
FIG. 7 is a flowchart of a subroutine in an indirect transfer process showing step 214 in detail in the image forming routine.

As shown in FIG. 7, at step 300 in the indirect transfer process sub-routine, the motor 51 drives to cause the platen nipping roller 28 to come into contact with the platen roller 21 (positioned at the first position), then at step 302, the pulse motors M1 and M2 rotate in the feed direction and the motor 51 is rotated. At step 304, the mark for positioning formed on the intermediate transfer sheet F is recognized by monitoring the light reception sensor Sa. It is determined whether the intermediate transfer sheet F is transported to the printing starting position by the unitized transmissive sensor Sc detecting the amount of rotation of the clock plate (not shown) connected to the forward and reverse rotating back-tension roller 49 to constantly rotate as a single unit with the feeding and returning of the intermediate transfer sheet F. If negative, the system returns to step 302 and continues transporting the intermediate transfer sheet F. If affirmative, the drive of the pulse motors M1 and M2 is stopped at step 306.

During that time, the thermal head 20*a* is positioned at the print idling position, and the starting edge of the thermal transfer sheet R, for example Y (yellow), is fed until it reaches a predetermined position. Such control is executed by detecting the trailing edge of the Bk (black) portion of the thermal transfer sheet R using the light receiving sensor Sd, and by detecting the rotation of the clock plate (not shown) disposed near the paired take-up rollers 37 using the unitized transmissive sensor Se, to detect the distance from the trailing edge of the Bk (black) portion of the thermal transfer sheet R having a predetermined width to the Y (yellow) portion.

Next, at step 308, a DC motor (not shown) drives to position the thermal head 20*a* at the printing position (a) to press against the platen roller 21 with the thermal transfer sheet R interposed therebetween. At the next step 310, while rotating the pulse motor M1, the pulse motor M2, and the motor 51 in the take-up (Rv) direction, the platen roller 21 is rotated in the counterclockwise direction by the solenoid clutch. This rotates the transport roller 48 in the counterclockwise direction. This starts the forming of the image using the color Y (yellow) on the intermediate transfer sheet F. In other words, the thermal head 20*a* heats the Y (yellow) ink layer on the thermal transfer film R, thereby starting to form the image on the receptive layer Fe on the intermediate transfer sheet F. The driving force provided by the pulse motor M1 rotates the platen roller 21 in the counterclockwise direction, and the driving force of the pulse motor M2 takes up the intermediate transfer film F using the intermediate transfer film supply portion 24. In synchronization to that, the thermal transfer film R is taken up by the thermal transfer film take-up unit 15.

At step 312, by determining whether the pulse motor M1 is driven for a predetermined number of pulses corresponding to a size of the image in the length direction formed on the intermediate transfer sheet F, it is determined whether the forming of the image on the intermediate transfer sheet F is completed. When it is negative, the system returns to step 310 and continues forming the image on the intermediate transfer sheet F. If affirmative, along with stopping the drive of the pulse motors M1, and M2, and the motor 51 at the step 314, it releases the interlock of the solenoid clutch on the platen roller 21 and transport roller 48. Note that the CPU reads out image data while converting each line into thermal energy, and sends positive image data to the thermal head unit 20 with predetermined coefficients applied thereto according to a type of intermediate transfer sheet F. The printing elements of the thermal head 20 are heated according to this mirror data.

At step 316, the DC motor (not shown) drives the eccentric cam 23 to retract the thermal head 20*a* to the print idling position (b) away from the platen roller 21. Then, at step 318, it is determined whether the forming of the image for the predetermined colors (YMC) is completed. If negative, the system returns to step 302 to form the image overlaying the color already formed on the receptive layer on the intermediate transfer sheet F (for example, Y) with the next color (for example, M). If affirmative, in other words, if it is determined that the forming of the image using the colors YMC is completed, the system proceeds to step 320. This forms a mirrored image onto the intermediate transfer sheet F.

At step 320, according to the amount of rotation of the clock plate (not shown) connected to the back tension roller 49, the pulse motor M2 drives to transport the intermediate transfer sheet F to a position where the trailing edge of the image region formed on the intermediate transfer sheet F at the image forming unit 9 passes through the guide rollers arranged near the pair of capstan rollers 43 and between the heat roller 16 and the intermediate transfer sheet take-up unit 25 beyond the heat roller 16 separated from the platen roller 27 in advance. When transporting, it is possible to reset the amount of transport to improve the transporting accuracy of the intermediate transfer sheet F by monitoring the output from the light receiving sensor Sb in the transfer unit 10 to detect the mark for positioning the intermediate transfer sheet F.

Also, at step 320, in parallel to transporting the intermediate transfer sheet F to the intermediate transfer sheet take-up unit 25, the card C is nipped by the second card turning unit 6 in advance and fed along the second card transport path P2 until the both edges thereof are nipped by the pair of capstan rollers 43 and the pair of discharge rollers 44.

Specifically, the pinch rollers at the card supply unit 3, the cleaner 4, and the first card turning unit 5 are driven to feed one blank card C from the card supply unit 3 to the horizontal card transport path P0. The cleaner 4 cleans both surfaces of the card C. When the leading edge of the card C is detected by the unitized transmissive sensor S1, the kick roller 3*a* stops rotating. Continuing, the card C is handed over to the magnetic encoder 7 by the first card turning unit 5 by rotating the pinch rollers on the first card turning unit 5. At that time, when the leading edge of a card C is detected by the unitized transmissive sensor S2, the cleaning rollers on the cleaner 4 stop rotating. After a predetermined amount of time, the pinch rollers start rotating in reverse. When information related to an owner of the card is recorded by the magnetic encoder 7, the card is received from the magnetic encoder 7 and both edges of the card C are nipped by the pinch rollers. This type of control can be executed by detecting the leading edge of the card C transported from the magnetic encoder 7 by the unitized transmissive sensor S2, and by stopping rotation of the pinch rollers when the card C is transported for a predetermined number of steps.

Next, the pinch rollers on the first card turning unit 5 and the second card turning unit 6 positioned to nip the horizontal card transport path and the second card transport path are stopped, and the turning units are rotated by 90 degrees. After positioning the pinch rollers at the positions to nip the first card transport path P1, the pinch rollers are driven again to transport the card C from the first card turning unit 5 to the second card turning unit 6. Then, with the rotation of the pinch rollers stopped, the units are rotated by 90 degrees again to return them to their original positions. The first card turning unit 5 returns to the status shown in FIG. 1. The second card turning unit 6 is positioned on the second card transport path P2 while nipping the card C. Note that the operation is basically performed while transporting to the transfer unit 10 of the intermediate transfer sheet F. However, in this embodiment, it is executed before the indirect transfer process subroutine only at the first time. Therefore, before starting step 320, the second card turning unit 6 is positioned on the second card transport path P2 while nipping the card C.

Also, at step 320, the pulse motor M3 (not shown) drives to rotate the rollers on the second card transport path P2, such as the pair of capstan rollers 41, 42 and 43, to transport the card C along the second card transport path P2. When the unitized transmissive sensor S7 detects the leading edge of the card C, the card C is transported further toward the discharge outlet for a predetermined number of pulses. This transports the card so that both-edges of the card C are in positions where they are nipped by the pair of capstan rollers 43 and the pair of discharge rollers 44. At this point, the pulse motor M3 is stopped. Note that when the unitized transmissive sensor S6 detects the leading edge of the card C, the rotational drive of the pinch rollers in the second card transport path P2 is stopped.

Next, at step 322, the pulse motor M2 and the motor 51 are rotated in the direction of take up to transport the intermediate transfer sheet F in the direction returning to the image forming unit 9 until the trailing edge of the image region on the intermediate transfer sheet F is positioned corresponding to the transfer starting position (position where an imaginary vertical line from the center of the heat roller 16 is orthogonal to the second card transport path P2 when the heat roller 16 is lowered). Then, the pulse motor M2 and the motor 51 are stopped. Also, at step 322, as shown in FIG. 1, the heat roller 16 is positioned in a retracted position away from the platen roller 27. Also, when transporting the intermediate transfer sheet F to the image forming unit 9 of the intermediate transfer sheet F, by monitoring the output from the light reception sensors Sc and Sb, the mark for positioning the intermediate transfer sheet F is detected. Transport precision is improved by resetting the transport amount.

Also, at step 322, in parallel to transporting of the intermediate transfer sheet F to the image forming unit 9, the card C with both edges nipped by the pair of capstan rollers 43 and the pair of discharge rollers 44 is transported to the image forming position. Specifically, the pulse motor M3 is rotated in reverse to transport the card C with both sides nipped over the second card transport path P2 to the second card turning unit 6. After the trailing edge of the card C is detected by the unitized transmissive sensor S7, the motor is driven for a predetermined number of pulses to transport the card C further to the second turning unit 6 where the reverse drive of the pulse motor M3 is stopped. This transports the leading edge of the card C (transport direction) to the position corresponding to the image forming position.

Next, at step 324, the heat roller rising and lowering cam is rotated to shift the heat roller 16 from a position separated from the platen roller 27 to touch the platen roller 27, then the rotation of the heat roller rising and lowering cam stops. At this point, the leading edge of the card C touches the heat roller 16. While a side of the card C is supported by the platen roller 27, the intermediate transfer sheet F is interposed between the other side of the card C and heat roller 45.

Next, at step 326, the system executes an indirect transfer that thermally transfers images formed on the reception layer Fe of the intermediate transfer film F to one side of the card C at the image forming portion 9 using heat and pressure of the heat roller 16. To describe the operations at step 326 in more detail, the card C with the other side supported by the platen roller 27 that rotates in the counterclockwise direction touches the heat roller 16 with one surface interposed by the intermediate transfer film F, and is transported to the second card turning unit 6. The peeling layer Fc on the intermediate transfer film F is peeled away from the base film Fa by heat of the heating lamp and pressure of the heat roller 16. The layer Fe formed thereupon with images and the overcoat layer are transferred to the other side of the card C as a single body.

In synchronization to the transfer, the intermediate transfer film F is re-wound around the intermediate transfer sheet supply unit 24. This operation is performed by the reverse drives of the pulse motors M2, M3, and the motor 51. During this time, at step 328, by monitoring whether the leading edge of the card C is positioned at the unitized transmissive sensor S6, the system determines whether the indirect transfer is completed. If it is not completed, the system returns to step 326 and continues the indirect transfer. If the indirect transfer is completed, it proceeds to the next step of 330. Positive images are formed on the entire surface of the card C through the transfer at the transfer portion 10. Note that the movements of the card C and the intermediate transfer film F during the indirect transfer are the same speed.

At step 330, stopping the drive of the pulse motors M2, M3 and the motor 51 stops the feeding of the intermediate transfer sheet (rewinding to the intermediate transfer sheet supply unit 24) and the transporting of the cards C to the second card turning unit 6. The heat roller rising and lowering can rotates again to retract the heat roller 16 away from the platen roller 27.

At step 332, the pulse motor M3 rotates in reverse to transport the card C further to the second card turning unit 6. After the leading edge of the card C is detected by the unitized transmissive sensor S9, the motor is driven for a predetermined number of pulses to transport the card C further to the second card turning unit 6 where the pulse motor M3 reverse drive is stopped. This transports the card C to the position where it is nipped by the pair of capstan rollers 41 and 42. Continuing, a cam mechanism (not shown) moves the roller 45 from the second card transport path P2 to a position where it touches the roller 46. This executes the decal process to correct any skewing of the card C that may have occurred during the intermediate transfer process.

At step 334, the pulse motor M3 drives to transport the card C over the second card transport path P2 and discharge it to outside of the printing apparatus 1. In the transport/discharge process at step 334, the pulse motor M3 drives to transport the card C along the second card transport path P2 in the direction toward the discharge outlet. During that time, it is judged whether the unitized transmissive sensor S8 detects the leading edge of the card C. If negative, the card is transported further. If affirmative, transport continues for a predetermined amount of time to completely discharge the card C to outside of the frame 2. This discharges the card C to the stacker 13 via the discharge outlet.

Next, the rotational drive of the pulse motor M3 is stopped, and the pulse motors M1 and M2 and the motor 51 are driven in reverse. It is determined by the unitized transmissive sensor Sc, described above, whether the intermediate transfer sheet F is transported for a predetermined distance. If negative, the system continues to transport the intermediate transfer sheet F. If affirmative, the system stops the drives of the pulse motors M1 and M2, and the motor 51 to complete the indirect transfer sub-routine and return to step 202.

If the decision is negative (direct transfer mode) at step 208 in FIG. 6, the direct transfer sub-routine for forming images on the card C using the direct transfer method is executed at step 216.

Figure 8:
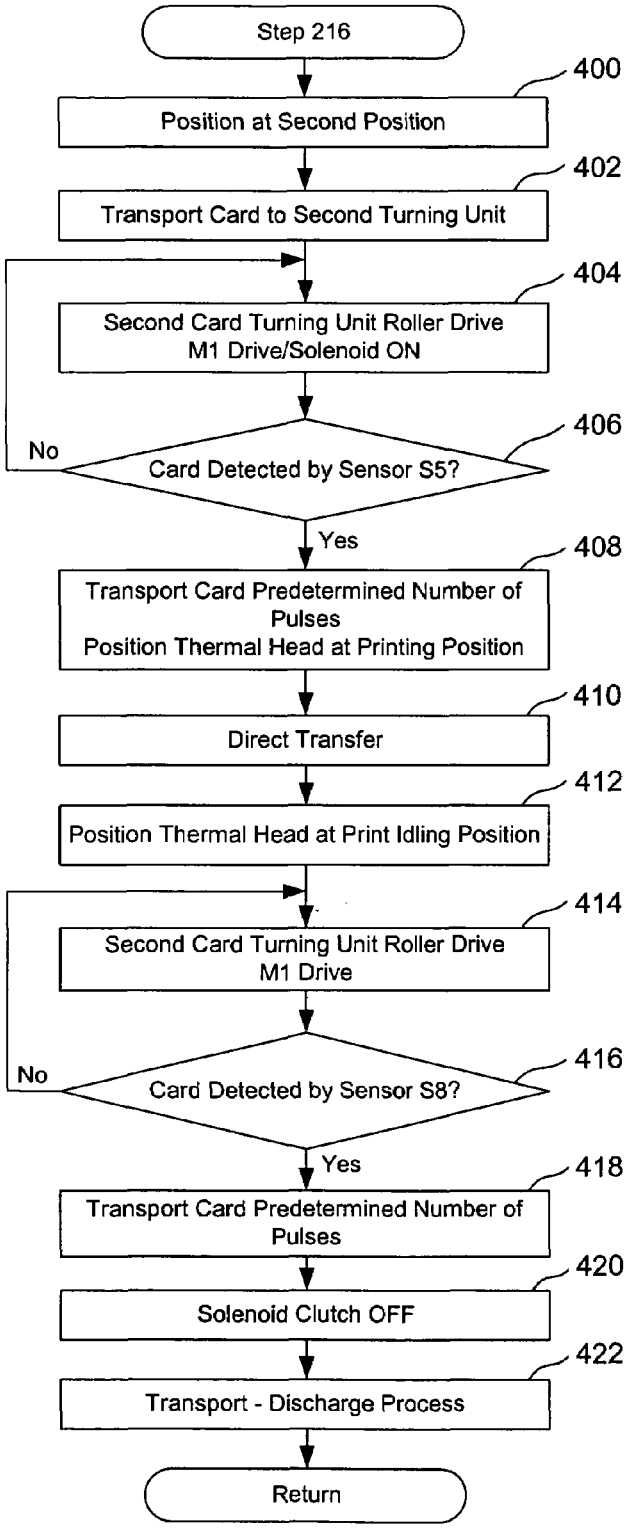
FIG. 8 is a flowchart of a subroutine in a direct transfer process showing step 216 in detail in the image forming routine.

As is shown in FIG. 8, in the direct transfer process subroutine, the motor 51 drives to position the platen nipping roller 28 at a position (second position) where it is in contact with a follower roller 12 at step 400. After this, at step 402, the card C is transported to the second card turning unit 6 at the position where the pinch rollers nip the first card transport path P1.

Specifically, as described at step 320, the pinch rollers in the card supply unit 3, the cleaner 4, and the first card turning unit 5 are driven to send out one blank card C from the card supply unit 3 to the horizontal card transport path P0. The cleaner 4 cleans both surfaces of the card C. When the leading edge of the card C is detected by the unitized transmissive sensor S1, the kick roller 3*a* stops rotating.

Continuing, the card C is handed over to the magnetic encoder 7 by the first card turning unit 5 by rotating the pinch rollers on the first card turning unit 5. At that time, when the leading edge of the card C is detected by the unitized transmissive sensor S2, the cleaning rollers on the cleaner 4 stop rotating. After a predetermined amount of time, the pinch rollers start rotating in reverse. When information related to the owner of the card is recorded by the magnetic encoder 7, the card is received from the magnetic encoder 7, and both edges of the card C are nipped by the pinch rollers.

Next, the first card turning unit 5 and the second card turning unit 6 rollers positioned to nip the horizontal card transport path and the second card transport path are stopped and the turning units are rotated by 90 degrees. After positioning the pinch rollers at positions to nip the first card transport path P1, the pinch rollers are driven again to transport the card C from the first card turning unit 5 to the second card turning unit 6. When the trailing edge of the currency is detected by the unitized transmissive sensor S3, the drive of the pinch rollers in the first card turning unit 5 is stopped, and the first card turning unit 5 rotates in reverse by 90 degrees to return to a position that faces the horizontal card transport path P0 shown in FIG. 1.

Continuing, at step 404, the pinch rollers of the second card turning unit 6 are driven, and the pulse motor M1 and motor 51 start rotating. At the same time, the solenoid clutch transmits driving force from the pulse motor M1 to the platen roller 21. Through this, the rotational drive of the pinch rollers on the second card turning unit 6, the platen roller 21, the pair of capstan rollers 11, and the platen nipping roller 28 is started to transport the card C to the image forming unit 9 along the first card transport path P1. Also, the transport is started for the intermediate transfer sheet F toward the intermediate transfer film supply portion 24 (to be rewound).

At the next step 406, the system determines whether the unitized transmissive sensor S5 arranged between the pair of capstan rollers 11 and the platen roller 21 detects the leading edge of the card C. If negative, it returns to the step 404 and continues to transport the card C to the image forming unit 9. If affirmative, at step 408, it transports the card C for a predetermined number of pulses until the leading edge of the card C reaches the print starting position (position where the platen roller is in contact with the first card transport path P1). Note that when the unitized transmissive sensor S4 detects the trailing edge of the card C, the rotational drive of the pinch rollers in the second card turning unit 6 is stopped.

During that time, the thermal head 20*a* is positioned at the print idling position (b) with regard to the platen roller 21, and the starting edge of the thermal transfer sheet R, for example Bk (black), is fed by a predetermined distance to the printing position. Also, at step 408, after feeding the thermal transfer sheet R by a predetermined distance, the system drives the DC motor (not shown) to rotate the eccentric cam 20 until the thermal head 20*a* is positioned at the printing position (a). This supports the other side of the card C at the platen roller 21 with the intermediate transfer film F interposed therebetween. One side touches the thermal head 20*a* with the thermal transfer sheet R interposed therebetween.

Continuing, at step 410, images are formed on one side of the card C using the direct transfer method. The CPU converts each line (or a plurality of lines) of the image data into thermal energy, adds predetermined coefficients to the thermal energy according to the type of card C, and sends that to the thermal head unit 20 via the thermal head control unit 19H. Each of the printing elements of the thermal head 20*a* is heated according to the positive image data. The pulse motor M1 rotates the platen roller 21 in the counterclockwise direction. In synchronization to this, the thermal transfer film R is taken-up by the thermal transfer film take-up portion 15, and images such as cautions for use are formed (printed) to one side of the card C in Bk (black) using the direct transfer method. This forms positive images over the entire surface (all areas) of the card C. Note that the intermediate transfer film F is transported at the same speed as the thermal transfer film R and the card C.

At the next step 412, the DC motor (not shown) rotates the eccentric cam 23 to position the thermal head 20*a* at the print idling position, thereby retracting the thermal head 20*a* from the card C. At step 414, after driving the pinch rollers on the second card turning unit 6 in reverse, the reverse drives of the pulse motor M1 and motor 51 start to rotate the platen roller 21, platen nipping roller 28, and the pair of capstan rollers 11 in reverse, thereby transporting the card C to the second card turning unit 6.

At step 416, the system determines whether the trailing edge of the card C is transported to the position of the unitized transmissive sensor S5. If it is determined to be negative, the system returns to step 414 and continues to transport the card C to the second card turning unit 6. If affirmative, at the next step 418, it transports the card C further for a predetermined number of pulses to the second card turning unit 6. Next, at step 420, when the drive of the pulse motor M1 is stopped, the system stops the interlock to the platen roller 21 using the solenoid clutch (not shown). The reverse rotation of the pinch rollers in the second card turning unit 6 is stopped to nip the card C using the pinch rollers in the second card turning unit 6 now substantially in the vertical state. At step 422, the system executes the transport/discharge process to transport the card C over the second card transport path P2 to outside of the printing apparatus 1.

In the transport/discharge process at step 422, the vertically oriented turning unit 6 is rotated by 90 degrees to allow the card C positioned on the first card transport path P1 to be transported to the discharge outlet over the second card transport path P2. This positions the card C with the other side facing upward on the second card transport path P2. Next, the pulse motor M3 (not shown) drives to transport the card C along the second card transport path P2 to the discharge outlet. The system determines whether the unitized transmissive sensor S8 detects the leading edge of the card C. If negative, the card is transported further. If affirmative, transport continues for a predetermined amount of time to completely discharge the card C outside the frame 2.

The rotating drive of the pulse motor M3 is stopped, the direct transfer sub-routine is completed, and the system returns to step 202. This discharges the card C to the stacker 13 via the discharge outlet. Note that when the unitized transmissive sensor S6 detects the leading edge of the card C, the rotational drive of the pinch rollers in the second card transport path is stopped. Also, in the direct transfer, the heat roller 16 on the transfer unit 10 remains separated from the platen roller 27.

The following will describe a printing apparatus in detail according to the second embodiment of the present invention. This embodiment employs a moving mechanism 70 that moves the platen nipping roller 28 into and out of contact with the platen roller 21, and an interconnecting mechanism 60 that interlocks the operation of the advancing and retracting mechanism 30 that advances and retracts the thermal head unit 20 with regard to the platen roller 21. Note that in this embodiment, the same numbers are applied to the components same as those in the first embodiment, including the advancing and retracting mechanism 30, thus explanations thereof are omitted. Only different parts are described.

Figure 4A:
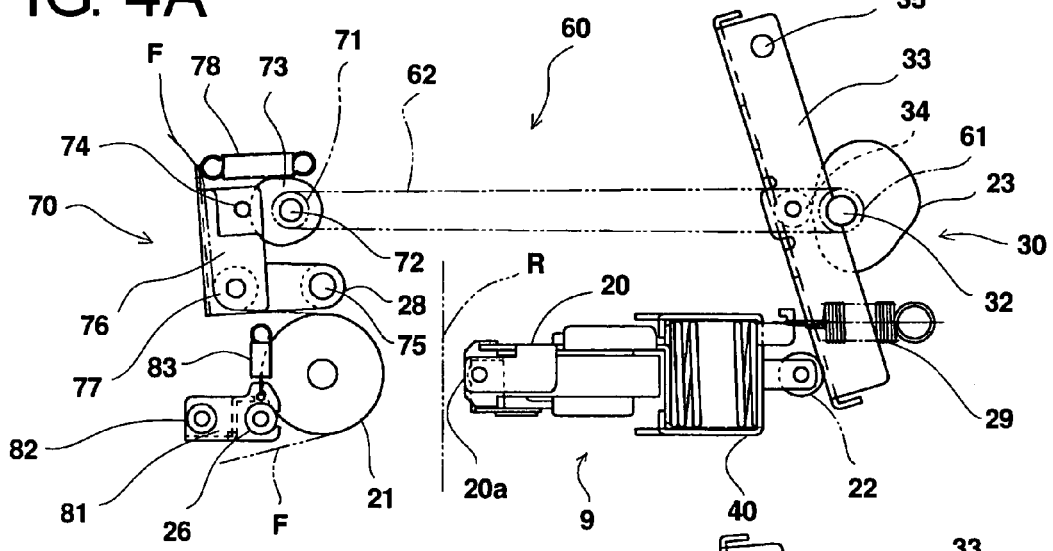
FIGS. 4(A) to 4(C) are views showing an operation of a thermal head unit of a printing apparatus according to a second embodiment of the invention.
Figure 4B:
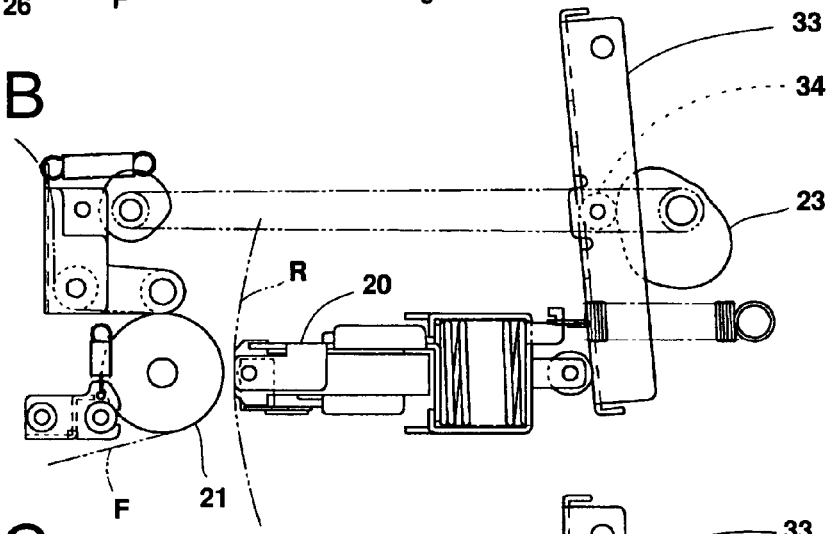
Figure 4C:
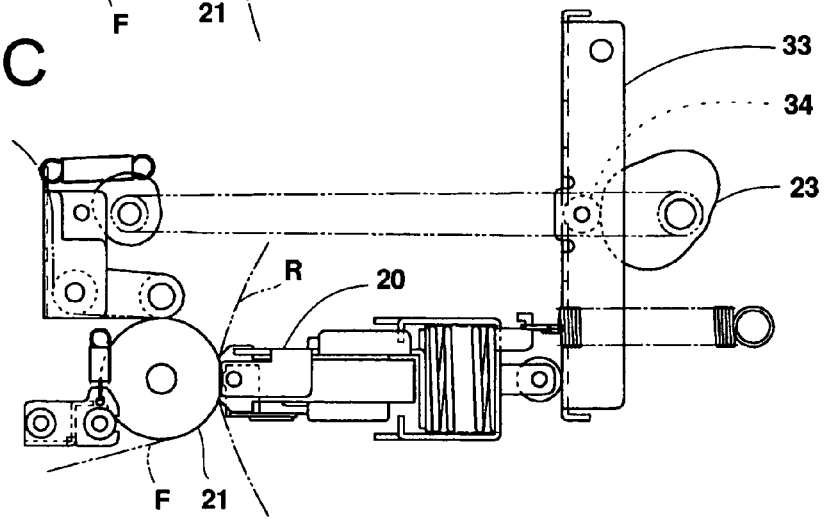

As shown in FIG. 4A to FIG. 4C, according to this embodiment of the present invention, the moving mechanism 70 comprises a pair of eccentric non-circular cams 73 that are mounted at predetermined positions on the shaft 72 that functions as the drive shaft; a shaft 74 that is arranged substantially parallel to the shaft 72 and touches the pair of eccentric cams 73; and a pair of L-shaped brackets 76 that holds the shaft 74 at one side and holds the shaft 75 inserted through the platen nipping roller 28 on the other side. On the central area of the bracket 76, the shaft 77 that is the center of rotation of the bracket 76 is supported between the pair of brackets 76. Both ends are supported on side plates on the frame 2. More specifically, the shaft 77 position is fixed.

Also, by transporting the intermediate transfer sheet F along the surface (large diameter portion shown in FIG. 3), the bracket 77 forms a part of the transport path for the intermediate transfer sheets F. The spring 78 is hooked between the pair of brackets 76 and the side plate on the frame 2. This applies an urging force (nipping force for the intermediate transfer sheet F) on the platen nipping roller 28 toward the platen roller 21 via the bracket 76.

Drive force applied to the advancing and retracting mechanisms 30 is transmitted to the interconnecting mechanism 60 in the moving mechanism 70 to move the platen nipping roller 28 into and out of contact with the platen roller 21. When a DC motor (not shown) drives, this drive is transmitted to the gear 31. It is then transmitted to the paired non-circular eccentric cams 23 via the shaft 32 disposed in the center of the gear 31. The unitized pulley 61 (with gears) is disposed on the gear 31, so that rotational drive force transmitted to the gear 31 is also applied to the pulley 61.

The pulley 71 (with gears) is disposed on one end of the shaft 72 of the pair of eccentric cams 73 in the moving mechanism 70 described above as a part of the moving mechanism 70. The timing belt 62 is trained between the pulley 61 and the pulley 71. Therefore, driving force is transmitted from the pulley 61 to the pulley 71 by the timing belt 62. This rotates the shaft 72, and the bracket 76 rotates around the shaft 77 by the rotating action of the eccentric cam 73. Accordingly, it is possible for the platen nipping roller 28 to come into and out of contact with the platen roller 21. Specifically, with the interconnecting mechanism 60 having the timing belt 62, the advancing and retracting action of the thermal head unit 20 to the platen roller 21 by the advancing and retract mechanism 30 is interconnected to the moving action of the platen nipping roller 28 to the platen roller 21 by the moving mechanism 70.

According to this embodiment of the present invention, similar to the drive motor 51 described above in the first embodiment, by controlling the drive of the DC motor (not shown) as the drive source that applies driving force to the advancing and retracting mechanism 30 and the moving mechanism 70 so that they rotate in both the forward and reverse directions, the thermal head 20*a* of the thermal head unit 20 can reciprocally move between the printing position (a) shown in FIG. 4C and the print idling position (b) shown in FIG. 4B. Accompanying this, the interconnecting mechanism 60 transmits drive to the moving mechanism 70 to rotate the eccentric cam 73 in the forward and backward directions. However, the eccentric cam 73 does not touch the shaft 74 when positioned at the two positions of the thermal head 20*a*, and the platen nipping roller 28 maintains a state in which it is pressed in contact with the platen roller 21 with the intermediate transfer sheet F interposed therebetween (see FIG. 4B and FIG. 4C).

In other words, the platen nipping roller 28 pushes the intermediate transfer sheet F against the platen roller 21 and maintains the status of contact with the platen roller 21, thereby enabling precise reciprocal transport of the intermediate transfer sheet F when forming images in many colors to the intermediate transfer sheet F using the thermal head 20*a* (see the state depicted in FIG. 4C), or when feeding the thermal transfer sheet R to a position of the next color while printing, or when the thermal head 20*a* is idling at a small distance from the platen roller 21 after the desired printing process is completed (see the state depicted in FIG. 4B).

Note that as shown in FIG. 4A, when the thermal head 20*a* is positioned at the thermal transfer sheet replacement position (c) which is a non-operating position, the drive transmitted to the moving mechanism 70 by the interconnecting mechanism 60 is received to rotate the eccentric cam 73 to touch the shaft 74. The mutual operations are interconnected to separate the platen and nipping roller 28 from the platen roller 21. In this state, it is easy to replace the intermediate transfer sheet F and perform maintenance on the apparatus.

Still further, in this embodiment, a plastic roller is used as the platen nipping roller 28, just as in the first embodiment. Also, a rubber roller 26 with a low hardness level is used as a cleaning roller to remove a foreign material adhered to the surface of the platen roller 21 by being in constant contact with the platen roller 21. As shown in FIG. 4A to FIG. 4C, the cleaning roller 26 is held on the bracket 81. The bracket 81 is urged to the upper direction of the printing apparatus 1 around the shaft 82 by the spring 83, so that the cleaning roller constantly is in contact with the platen roller.

When shifting to the predetermined printing operation by replacing the intermediate transfer sheet F with a new intermediate transfer sheet F in the printing apparatus 1, or replacing the thermal transfer sheet R with a new thermal transfer sheet R in the printing apparatus 1, in other words when shifting to the printing operation from the status shown in FIG. 4A, in addition to the initializing operation of the printing apparatus 1, the control unit 19 described above controls the rotation of the roller that feeds the intermediate transfer sheet F including the platen roller 21 to reciprocally move the intermediate transfer sheet F for a predetermined number of times while the platen nipping roller 28 is in the state shown in FIG. 4A away from the platen roller 21. (The supply and take-up of the intermediate transfer sheet F are performed between the intermediate transfer sheet supply unit 24 and the intermediate transfer sheet take up unit 25.) This removes any skew (swerving correction) in the intermediate transfer sheet F. Then, each of the drive mechanisms including the moving mechanism 70 is controlled, so that the nipping roller 28 moves to come into contact with the platen roller 21 by the moving mechanism 70 having received the transmission of drive by the interconnecting means 60.

The following will describe actions of the printing apparatus 1 according to the first and second embodiments of the present invention.

According to the embodiments, when the indirect transfer mode (second mode) is set using the touch panel (or external computer) as the mode setting means, the platen nipping roller 28 touches the platen roller 21 by the moving mechanisms 50 and 70. Therefore, this prevents a decrease in transport precision that is caused by slack when transporting the intermediate transfer sheet F, thereby improving the transporting precision. Also, when the direct transfer mode (first mode) is set, the platen nipping roller 28 is separated from the platen roller 21 by the moving mechanisms 50 and 70. Not only a foreign material such as dirt adhered to the surface of the platen roller 21 is prevented from traveling further, it is also possible to share the parts, thereby lowering cost of the apparatus by using this as the card transport roller protruding into the first card transport path P1 for the card C.

Note that because the platen nipping roller 28 comes into contact with the transfer surface of the intermediate transfer sheet F with images formed thereon in the indirect transfer mode, it is preferable that a roller is made from POM. Therefore, compared to a rubber roller for the platen nipping roller 28, this can prevent a reduction in the quality of the image formed on the intermediate transfer sheet F by any dirt adhered to the roller. Still further, in this embodiment, the rubber roller 26 with a low hardness level is used to remove a foreign material that adheres to the surface of the platen roller 21 by constantly contacting the outer surface of the platen roller 21, so that high quality of the images formed on the intermediate transfer sheet F can be maintained.

Still further, because the configuration uses the arm 33 for attaining a predetermined space between the thermal head 20*a* and the platen roller 21 and moves the thermal head unit 20 by connecting the eccentric and 23 and the rollers 22 on the head holder 20 side (along with the amount of swinging rotation of the arm 33), the extending of the eccentric cam 23 itself can make the printing apparatus one more compact.

Also, because the configuration reciprocally moves the intermediate transfer sheet F for a plurality of times while the platen nipping roller 28 is separated from the platen roller 21 for setting the intermediate transfer sheet F, skewing (swerving correction) of the intermediate transfer sheet F is corrected according to the second embodiments of the present invention.

Note that an example is provided as the configuration that uses the arm 33 to connect the eccentric cam 23 and the roller 22 on the head holder 20 side (along with the amount of swinging rotation of the arm 33), but it is also perfectly acceptable that the eccentric cam 23 touches the roller 22 on the head holder 20 side. In this case, by touching the eccentric cam 23 with the roller 22 on the head holder 20 side, it is perfectly acceptable for the eccentric cam 23 to be slightly larger than the one in the embodiment described above in order to obtain the advancing and retracting movement amounts of the thermal head 20*a* (head holder 20).

Still further, an example is provided for nipping the card C with information recorded in advance by the magnetic encoder 7 in the second card turning unit 6, but it is also acceptable to nip the card C in the first card turning unit 5. Therefore, while the card C is being recorded with information by the magnetic encoder 7, the next card C can be handed over from the first card turning unit 5 to the second card turning unit 6 without going through the magnetic encoders 7. This makes it possible to transfer (print) images formed on the intermediate transfer sheet F onto the same or a different card. This kind of embodiment for handling the same or different card comprises a plurality of paired rollers on the second card transport path P2 in the embodiment described above. Therefore, the card C is stopped over the second card transport path P2, and the direct transfer is performed over the first card transport path P1. If necessary, it is possible to nip the card C after the direct transfer process from the second card during unit 6 to the first card turning unit 5.

If the pre-recorded cards C are stored in the card supply unit 3, either the first card turning unit 5 or the second card turning unit 6 can be omitted, and the horizontal card transport path P0 and the second card transport path P2 can be formed on a same transport path. Still further, although the embodiment above describes an example of forming images to one side of the card C using the direct transfer method or the indirect transfer method, it is also perfectly acceptable to form images on one side of the card C using the direct transfer method and form images on the other side of the card C using the indirect transfer method. To perform this type of duplex printing, the function of the second turning unit 6 can be focused on. Excluding step 334 in FIG. 7, after executing the indirect transfer sub-routine, the card C can be transported to the second turning unit 6, and rotated by 90 degrees. Then, in order to form images using the direct transfer onto the surface opposite to that with images formed using the indirect transfer, the following is possible. Even if executing the direct transfer process sub-routine after step 400 and step 404 in FIG. 8, after the direct transfer process sub-routine is executed, excluding step 422 in FIG. 8, the indirect transfer process sub-routine is executed while the card C is nipped in the second card turning unit 6 shown in FIG. 7. Then, the card C, still nipped in the second card turning unit 6 at step 320 in the indirect transfer sub-routine, is rotated by 90 degrees, so that it can then be transported to the transfer unit 10.

Also, this embodiment describes one example of the image forming unit 9, but this invention is not limited to one and can also comprise a plurality of image forming units 9 (for example, two). In this way, at one image forming portion, images can be formed on the card C, and images can be formed on the intermediate transfer film F at the other image forming portion. This further enhances printing speed while reducing errors such as entangling of the intermediate transfer sheet.

In addition, the above embodiment describes an example in which the modes are input and printing is started via the touch panel 8 and an external computer. However, it is also perfectly acceptable to store image data in the control unit 19 microcomputer 19A, RAM, VRAM, or SDRAM via information recording medium such as an FD, MO or ZIP disk. Also, the above invention is not limited to the hardness of the platen roller 21, the platen nipping roller 28, the intermediate transfer film F and the card C, and can change within the scope of the invention.

The disclosure of Japanese Patent Application No. 2003-360777, filed on Oct. 21, 2003, is incorporated in the application.

While the invention has been explained with reference to the specific embodiments of the invention, the explanation is illustrative and the invention is limited only by the appended claims.

What is claimed is:

1. A printing apparatus comprising:

printing means for selectively forming an image on a recording medium, and a transfer medium;

a platen roller arranged opposite to the printing means;

a nipping roller for nipping the transfer medium with the platen roller;

mode setting means for setting a first mode for forming the image on the recording medium and a second mode for forming the image on the transfer medium; and moving means for moving the nipping roller to contact with and separate from the platen roller according to the first mode or the second mode set by the mode setting means.

2. A printing apparatus according to claim 1, wherein said moving means moves the nipping roller to separate from the platen roller when the mode setting means sets the first mode, and moves the nipping roller to contact with the platen roller when the mode setting means sets the second mode.

3. A printing apparatus according to claim 2, wherein said moving means is arranged such that the nipping roller separate from the platen roller advances into a card transport path for transporting the recording medium when the mode setting means sets the first mode.

4. A printing apparatus according to claim 3, wherein said moving means includes a support member for supporting the nipping roller, and a drive mechanism for driving the support member to move the nipping roller between a first position where the nipping roller contacts the platen roller and a second position where the nipping roller advances into the card transport path to be able to transport the recording medium.

5. A printing apparatus according to claim 1, wherein said nipping roller is formed of a plastic roller for contacting a transfer surface of the transfer medium where the image is formed.

6. A printing apparatus according to claim 1, further comprising a cleaning roller for contacting an outer circumference of the platen roller to remove a foreign material adhered thereto.

7. A printing apparatus comprising:

printing means for selectively forming an image on a recording medium in a form of a card and a transfer medium in a form of a film;

a platen roller arranged opposite to the printing means for supporting the recording medium and the transfer medium;

a nipping roller for nipping the transfer medium with the platen roller;

moving means for moving the nipping roller to contact with and separate from the platen roller;

transfer medium transport means for transporting the transfer medium; and transfer means for transferring the image formed on the transfer medium to the recording medium or a different recording medium.

8. A printing apparatus according to claim 7, further comprising control means for controlling the transfer medium transport means and the moving means so that when the transfer medium is placed at a predetermined position, the moving means moves the nipping roller to contact the platen roller after the transfer medium transport means reciprocally moves the transfer medium for a predetermined number of times relative to the platen roller.

9. A printing apparatus according to claim 7, further comprising advancing and retracting means for advancing and retracting the printing means relative to the platen roller, and an interconnecting mechanism for interconnecting the printing means and the nipping roller so that advancing and retracting movements of the printing means by the advancing and retracting means associate with movements of the nipping roller by the moving means.

10. A printing apparatus according to claim 9, wherein said interconnecting mechanism interconnects the printing means and the nipping roller to move mutually so that the moving means moves the nipping roller to separate from the platen roller when the advancing and retracting means moves the printing mean to a non-image forming position away from the platen roller by a first predetermined distance.

11. A printing apparatus according to claim 10, wherein said interconnecting mechanism holds the nipping roller in a state in which the nipping roller contacts the platen roller when the advancing and retracting means moves the printing means to an idling position away from the platen roller by a second predetermined distance smaller than the first predetermined distance where the printing means can form the image.

12. A printing apparatus according to claim 7, wherein said nipping roller is formed of a plastic roller for contacting a transfer surface of the transfer medium where the image is formed.

13. A printing apparatus according to claim 7, further comprising a cleaning roller for contacting an outer circumference of the platen roller to remove a foreign material adhered thereto.

* * * * *